US006454125B1

(12) United States Patent
Rink, Jr.

(10) Patent No.: US 6,454,125 B1
(45) Date of Patent: Sep. 24, 2002

(54) STACKED ASSEMBLY OF DISPOSABLE RAIN HOODS

(76) Inventor: Joseph Bernard Rink, Jr., 4609 Beau Lac La., Metairie, LA (US) 70002

( * ) Notice: Subject to any disclaimer, the term of this patent is extended or adjusted under 35 U.S.C. 154(b) by 0 days.

(21) Appl. No.: 10/039,379

(22) Filed: Jan. 2, 2002

Related U.S. Application Data

(63) Continuation of application No. 09/484,104, filed on Jan. 14, 2000, now Pat. No. 6,341,381, and a continuation of application No. 09/495,086, filed on Jan. 31, 2000, now Pat. No. 6,389,723, and a continuation of application No. 09/548,488, filed on Apr. 13, 2000.

(51) Int. Cl.[7] ..... B65H 3/58
(52) U.S. Cl. ..... 221/26; 221/27; 206/554
(58) Field of Search ..... 221/26, 27; 206/493, 206/554, 526, 494; 211/54.1, 59.1

(56) References Cited

U.S. PATENT DOCUMENTS

| | | | | |
|---|---|---|---|---|
| 191,645 | A | | 6/1877 | Breese |
| 1,398,165 | A | | 11/1921 | Whiteside |
| 1,618,297 | A | | 2/1927 | Reinhold |
| 2,191,589 | A | | 2/1940 | Sacks |
| 2,341,119 | A | * | 2/1944 | Rost |
| 2,421,934 | A | | 6/1947 | Goltieri |
| 2,441,561 | A | | 8/1948 | Brenner |
| 2,484,269 | A | | 10/1949 | Carlson |
| 2,694,812 | A | | 11/1954 | Neuburger |
| 2,711,538 | A | | 6/1955 | Cordero |
| 2,740,127 | A | | 4/1956 | Whitehead |
| 2,903,705 | A | | 9/1959 | Price |
| 3,014,221 | A | | 11/1961 | Brunetto |
| 3,064,267 | A | | 11/1962 | Tullos |
| 3,111,677 | A | | 11/1963 | Artzt |
| 3,221,927 | A | * | 12/1965 | Lowry |
| 3,252,236 | A | | 5/1966 | Davis |
| 3,285,406 | A | | 11/1966 | Winesett |
| 3,318,444 | A | | 5/1967 | Weicher et al. |
| 3,466,665 | A | | 9/1969 | Mooney |
| 3,556,115 | A | | 1/1971 | Benson |
| 3,946,443 | A | | 3/1976 | Knight |
| 3,951,160 | A | | 4/1976 | Nitu |
| 3,978,601 | A | | 9/1976 | Catron |
| 4,055,852 | A | | 11/1977 | Wallace |
| 4,067,067 | A | | 1/1978 | Newls |
| 4,218,777 | A | | 8/1980 | Munnikhuysen |
| 4,313,229 | A | | 2/1982 | Villafañe |
| 4,502,599 | A | | 3/1985 | Perecman |
| 4,537,330 | A | | 8/1985 | Gelbard |
| 4,557,384 | A | | 12/1985 | Membrino |
| 4,781,474 | A | | 11/1988 | Sengewald |
| 4,887,316 | A | | 12/1989 | Morandini |
| 4,932,560 | A | * | 6/1990 | Roen ..... 221/26 |

(List continued on next page.)

FOREIGN PATENT DOCUMENTS

| | | | | |
|---|---|---|---|---|
| EP | 0301149 A1 | * | 2/1989 | ..... 221/26 |

*Primary Examiner*—David H. Bollinger
(74) *Attorney, Agent, or Firm*—Adams & Reese, LLP

(57) ABSTRACT

A stacked assembly of disposable rain hoods for displaying and dispensing from a display stand comprising a plurality of disposable rain hoods stacked together and a display holder, the display holder configured to be suspended from the display stand. Each rain hood rain hood has a suspension portion extending from a lower edge of opposing flaps of the rain hood, the suspension portion being detachably connected to the lower edge of the flaps by a frangible perforation. The stack of disposable hoods are fixedly attached to the display holder via the suspension portions of the rain hoods such that a selected disposable rain hood may be selectively detached from the suspension portion by pulling the disposable hood relative to the holder to thereby break the frangible perforation. A head stop is preferably provided for properly positioning the head of a user in the disposable rain hood.

10 Claims, 3 Drawing Sheets

U.S. PATENT DOCUMENTS 5,099,526 A 3/1992 Baena
5,119,968 A 6/1992 Palmer
D332,311 S 1/1993 Redding
5,287,560 A 2/1994 Garcia
5,575,393 A * 11/1996 Gebhardt ..... 206/554
5,683,603 A 11/1997 Gebka
5,732,833 A * 3/1998 Alvarado et al. ..... 211/59.1
5,788,080 A 8/1998 Sili et al.
5,832,538 A 11/1998 Williams
5,864,887 A 2/1999 Kozawa
6,065,233 A 5/2000 Rink
6,116,424 A * 9/2000 Leu ..... 206/554
6,142,302 A 11/2000 Requena
6,341,381 B1 * 1/2002 Rink, Jr. ..... 2/410
6,389,723 B1 * 5/2002 Rink, Jr. ..... 40/642.02

* cited by examiner

STACKED ASSEMBLY OF DISPOSABLE RAIN HOODS

CROSS REFERENCE TO RELATED APPLICATIONS

This application is a continuation of and claims priority to application Ser. No. 09/484,104, filed Jan. 14, 2000 now U.S. Pat. No. 6,341,381, application Ser. No. 09/495,086, filed Jan. 31, 2000 now U.S. Pat. No. 6,389,723 and application Ser. No. 09/548,488, filed Apr. 13, 2000, all of which are pending.

STATEMENT REGARDING FEDERALLY SPONSORED RESEARCH OR DEVELOPMENT

Not applicable

REFERENCE TO A MICROFICHE APPENDIX

Not applicable

FIELD OF INVENTION

The present invention relates to rain protection garments, such as hoods and ponchos, and more particularly to disposable rain hoods for display on display racks.

BACKGROUND OF THE INVENTION

Rain protection garments, such as rain coats, rain hoods, ponchos, and the like, are used to keep individuals dry during rain showers. Such garments are typically designed for repeated use, and are therefore made of durable, rain impermeable materials such as canvas, oilcloth, nylon and the like. Disposable rain hoods and ponchos are also available. Disposable rain hoods are typically made of plastic sheets. Disposable rain hoods find particular uses at outdoor events, such as festivals and sporting events, where a sudden, unexpected shower may catch individuals without umbrellas or rain protection garments. In such circumstances, disposable rain hoods can be sold at low cost or donated to individuals attending the event, and can then discarded when no longer needed.

The inventor has developed an apparatus and method for supplying disposable receptacles for umbrellas. The disposable receptacles consist of an elongated plastic bag that is designed to fit over a collapsed umbrella. The disposable receptacles keep wet umbrellas from dripping water, and thus prevent slips, soiling of floors and carpets, and other consequences of tracking rain water into a public building. A stand is provided for displaying and dispensing the disposable receptacles. The stand consists generally of a base, a pole extending substantially vertically upward from the base, and a bracket member for holding a plurality of disposable receptacles for umbrellas. Such display stands and disposable receptacles have been successful on the market, and are used particularly in public buildings that have heavy foot traffic. However, the disposable receptacles are useful only for individuals who happen to have umbrellas with them. There is thus a need for a disposable rain hood that can be conveniently displayed on such stands, and thus can be dispensed as needed during rain showers.

OBJECTS AND SUMMARY OF THE INVENTION

It is an object of the invention to provide disposable rain hoods configured for convenient display on display stands, such as in compact stacks of hoods.

It is another object of the invention to provide a disposable rain hood that is inexpensive to manufacture, and therefore can be distributed free of charge or at low cost to the general public.

It is another object of the invention to provide a means of displaying the disposable rain hoods from display stands for distribution as needed during rain showers.

It is yet another object of the invention to provide a disposable rain hood that fits comfortably on a user and can be readily secured to the user.

These and other objects and advantages of the invention shall become apparent from the following general and preferred description of the invention.

Accordingly, a stacked assembly of disposable rain hoods for displaying and dispensing from a display stand is provided comprising a plurality of disposable rain hoods, the plurality of disposable hoods stacked together, and a display holder, the display holder having a means thereon for suspending the display holder from the display stand. Each rain hood comprises a pair of opposing flaps, the flaps attached to one another substantially along respective upper edges thereof, the flaps further attached to one another substantially along respective rear edges thereof, the upper and rear edge attachments providing a rain-impermeable barrier along the upper and the rear edges of the disposable rain hood, and the disposable rain hood having a substantially open front edge and a substantially open lower edge for receiving a head and torso of a user of the disposable rain hood. The pair of flaps are preferably formed from a single lengthwise sheet of plastic, the sheet being folded substantially along a width-wise or lengthwise centerline thereof to thereby form the pair of lengthwise opposing flaps; in this configuration, the fold forms either the upper or rear edge of the disposable rain hood, and an adjacent side is sealed by heat sealing to form the other sealed edge.

Each rain hood has a suspension portion extending from the lower edges of the flaps, the suspension portion being detachably connected to said lower edge of said flaps by a frangible perforation. The stack of disposable hoods are fixedly attached to the display holder via the suspension portions of the rain hoods such that a selected disposable rain hood may be selectively detached from the suspension portion by pulling the disposable hood relative to the holder to thereby break the frangible perforation. The display holder is preferably a piece of cardboard, the piece of cardboard being folded over a plurality of the suspension portions, and opposing flaps of the display holder being attached to one another by a plurality of staples passing through the plurality of suspension portions.

A head stop is preferably provided for properly positioning the head of a user in the disposable rain hood. The head stop further attaches the respective opposing flaps to one another. The head stop extends downward substantially from the sealed upper edge of the disposable hood and extends substantially parallel to an upper portion of the sealed rear edge. The head stop is also preferably positioned a sufficient distance from the open front edge of the disposable rain hood to thereby permit the head stop to function as a rear barrier for a back portion of the head of the user while the hood simultaneously shields the head of the user from rain. The head stop is preferably formed by heat sealing the flaps to one another along the desired position of the head stop.

PREFERRED EMBODIMENTS OF THE INVENTION

Figure 1:
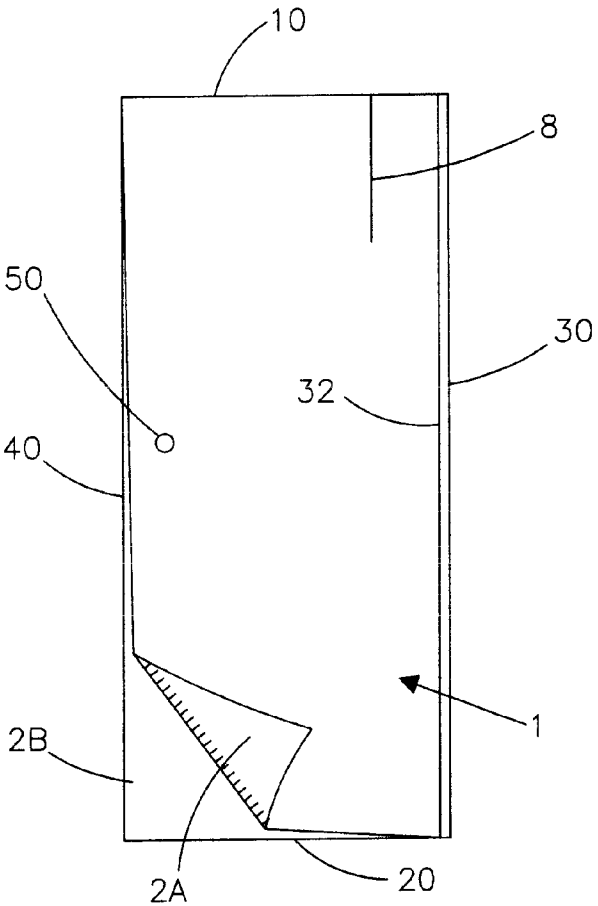
FIG. 1 is a side view of one preferred embodiment of the disposable rain hood of the invention.

FIG. 1 shows a side view of a preferred embodiment of a disposable rain hood of the invention 1, the disposable rain hood being particularly designed for dispensing from a display stand. The rain hood comprises, generally, a pair of opposing flaps 2A, 2B, the flaps being composed of conventional plastic sheeting or other inexpensive rain impermeable material. In FIG. 1, flap 2A is shown partially folded back at a front-lower corner. The flaps 2A, 2B are attached to one another substantially along respective upper edges 10 thereof. The flaps 2A, 2B are further attached to one another substantially along respective rear edges 30 thereof. The upper 10 and rear 30 edge attachments provide a rain-impermeable barrier along the upper 10 and the rear 30 edges of the disposable rain hood. With the flaps 2A, 2B sealed together in the foregoing manner, the disposable rain hood 1 has a substantially open front edge 40 and a substantially open lower edge 20. The open front 40 and lower edges 20 permit the disposable rain hood 1 to receive a head and torso of a user 100, as shown most clearly in FIG. 2.

The pair of flaps 2A, 2B are preferably formed from a single lengthwise sheet of plastic. In the preferred embodiment shown in FIG. 1, the sheet is folded substantially along a width-wise centerline 10 thereof to thereby form the pair of lengthwise opposing flaps 2A, 2B. The sheet is preferably about 37 by 30 inches (94 by 76 cm) prior to folding, which forms an approximately 37 by 15 inch (94 by 38cm) hood after folding. The fold 10 forms the upper edge 10 of the disposable rain hood 1, and the rear edge attachment 30 is preferably formed by heat sealing the rear edges 30 of the flaps to one another. Such heat sealing methods are well known to those of ordinary skill in the art, but as far as is known such heat sealing methods have not been applied to disposable rain hoods as described herein. FIG. 1 shows an example of a heat seal 32 sealing rear edge 30. In another embodiment, the sheet is folded substantially along a lengthwise centerline 30 thereof to thereby form the pair of lengthwise opposing flaps 2A, 2B. In this embodiment, the fold 30 forms the rear edge 30 of the disposable rain hood, and the upper edge attachment 10 is formed by heat sealing the upper edges 10 of the flaps 2A, 2B to one another. Alternatively, the disposable rain hood 1 can be formed from a pair of lengthwise sheets 2A, 2B, the two sheets being sealed together, preferably by heat sealing, to form the upper 10 and rear 30 edge attachments.

Figure 2:
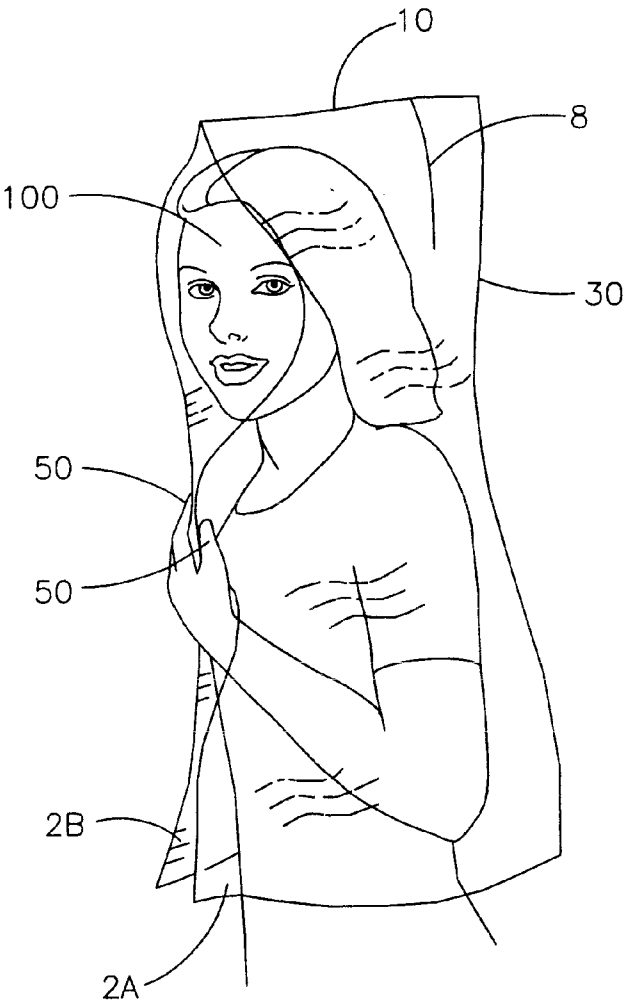
FIG. 2 is a perspective front-side view of one preferred embodiment of the disposable rain hood of the invention as shown in FIG. 1 illustrating the disposable rain hood covering the head and torso of a user.

As shown most clearly in FIG. 2, the apparatus of the invention 1 is preferably further provided with a head stop 8. The head stop 8 serves to properly position the head of a user 100 in the disposable rain hood 1. The head stop 8 further attaches the respective flaps 2A, 2B to one another. The head stop 8 extends downward substantially from the sealed upper edge 10 of the disposable hood and extends substantially parallel to an upper portion of the sealed rear edge 30. The head stop 8 is positioned a sufficient distance from the open front edge 40 of the disposable rain hood 1 to thereby permit the head stop 8 to function as a rear barrier for a back portion of the head of the user 100 while the rain hood simultaneously shields the head of the user 100 from rain. The head stop 8 is preferably formed by heat sealing the flaps 2A, 2B to one another along the desired position of the head stop 8. Alternatively, stapling, stitching, or the like could be used to form the head stop 8.

The disposable rain hood of the invention 1 is also preferably provided with at least one hole 50 positioned substantially along the forward edge 40 of each of the flaps 2A, 2B. The holes 50 are positioned to permit the forward edges 40 of the disposable rain hood to be selectively held together either by fingers of the user 100 or by a tie (e.g. string or a twist-tie) passing through the holes (the tie taking the place of fingers) to thereby secure the hood on the user, as shown in FIG. 2. This feature is designed particularly for windy conditions, where a light-weight disposable rain hood 1 could be blown off of a user 100 by a gust of wind. Although only one pair of holes 50 is shown in the drawings, additional holes 50 can be provided along the open edge 40 to thereby accommodate different sizes and preferences of users 100.

Figure 4:
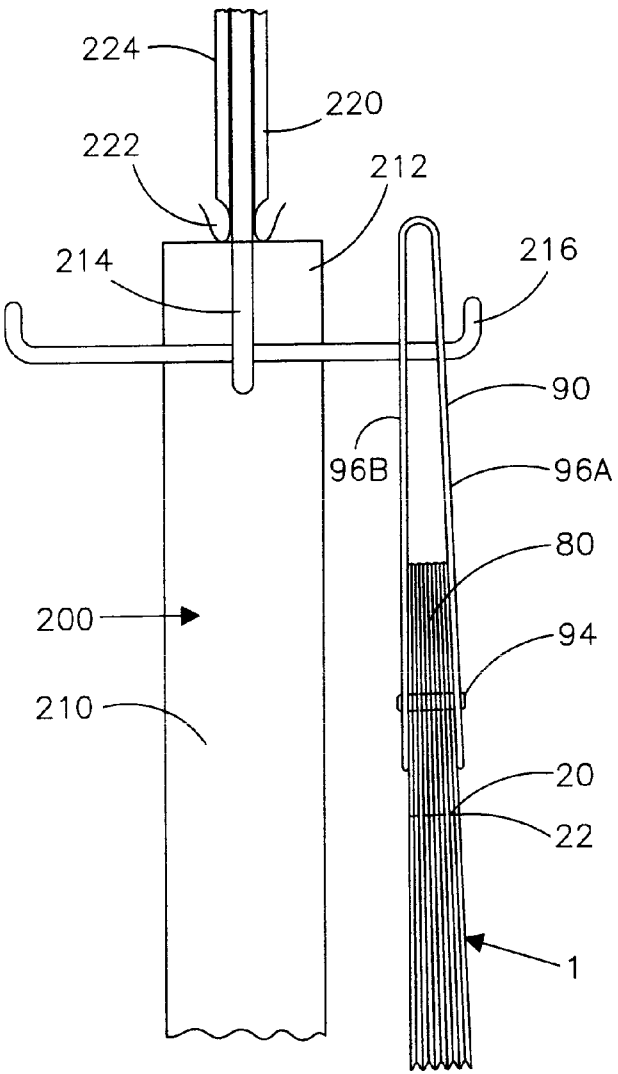
FIG. 4 is a partial side-view of the display stand of FIG. 3, illustrating a side view of an upper portion of a stack of disposable rain hoods and details of how the stack of rain hoods may be suspended from the display stand.
Figure 3:
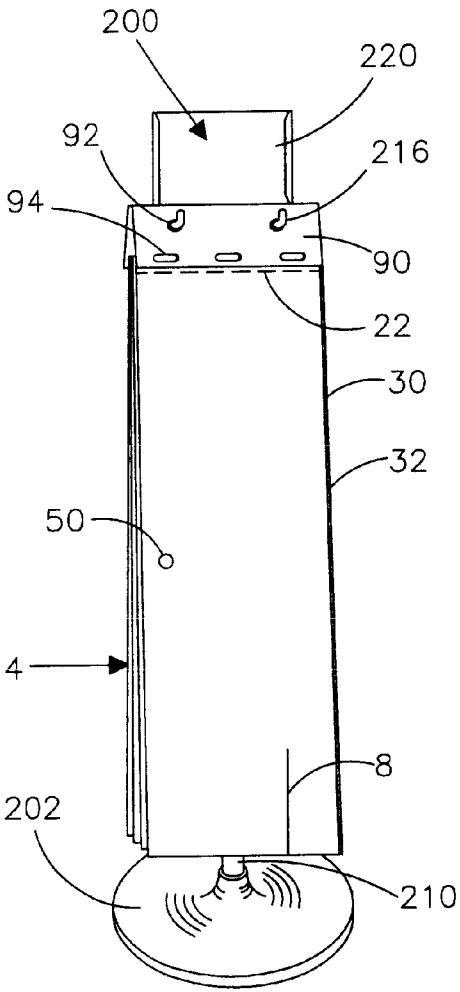
FIG. 3 is a perspective view of one preferred embodiment of the invention, showing a plurality of disposable rain hoods stacked together and suspended from a display stand.

FIGS. 3 and 4 show a preferred embodiment of the invention 1 displayed on a display stand 200. Such stands are distributed by Custom Specialties & Supply, Inc. of Metairie, La. Heretofore, such stands have been used for the display and dispensing of bags for holding wet umbrellas. As shown in FIGS. 3 and 4, such display stands 200 comprise a base 202 for supporting the stand, a pole 210 extending substantially vertically upward from the base 202, and a pair of display prongs 216 positioned adjacent an upper end 212 of the pole 210. The display stand 200 is also preferably provided with a sign holder 220 on the upper end 212 of the pole 210. In the embodiment shown most clearly in FIG. 4, the sign holder 220 consists of a pair of parallel plates 220 having an inwardly turned lower edge 222 and inwardly turned side edges 224, the inwardly turned edges providing a means for holding a sign insert. The sign insert can contain writing informing passers-by about the disposable rain hoods 1, and/or can be provided with advertising information.

Figure 5:
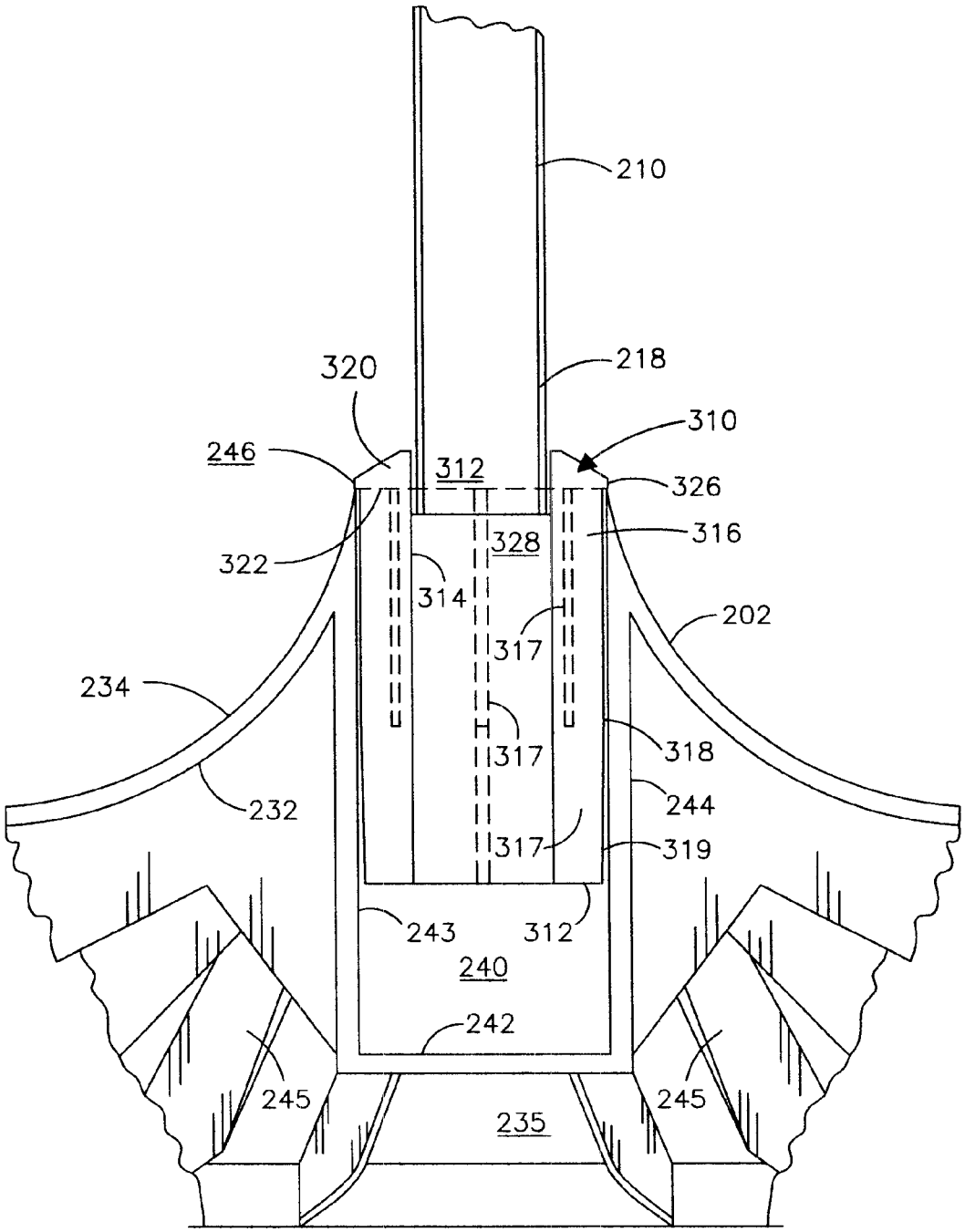
FIG. 5 is a cross-sectional side view of a preferred embodiment of a base of the display stand of FIG. 3, illustrating internal features of the base.

Although numerous designs and configurations can be used for the display stand 200, FIG. 5 shows a design for a base 202 for the display stand 200 that has been useful for displaying disposable receptacles for umbrellas, and which will likewise prove useful for displaying and dispensing disposable rain hoods 1. The base 202 shown in FIG. 5 has a generally cylindrical opening 240 that extends substantially vertically into the base 202. Any of a number of configurations could be used for the base 202, provided that the base is light in weight (light weight being preferable to facilitate movement, repositioning, shipping and storage of the display stand 200) and is capable of maintaining the cylindrical opening 240, insert 310, and pole 210 in a substantially vertical orientation. The configuration of the base 202 shown in FIGS. 3 and 5 is a modified flattened cone which is circular when viewed from above. This configuration provides a solid base, minimizes the volume required for the base, and is esthetically pleasing. In the embodiment of the base 202 shown in FIG. 5, the vertical generally cylindrical wall 243 of the opening 240 is contiguous with the base 202. In this embodiment, the upper end 246 of the opening 240 forms a support for the insert 310 on the outer surface 234 of the base 202, as will be described in further detail below. Other support means could be provided, however, such as sizing the insert 310 and opening 240 such that the lower end 312 of the insert 310 rests on a closed bottom end 242 of opening 240.

In order to minimize the weight of the base 202, the base 202 shown in FIG. 5 has a substantially hollow interior 235. In order to provide additional support to the base 202, particularly in view of the minimization of weight and materials used in forming the base, it is preferable to provide the interior 235 of the base 202 with a plurality of support ribs 245. The support ribs 245 preferably extend radially outward from the base opening 240. In a preferred embodiment, the support ribs 245 are contiguous with the exterior surface 244 of the opening 240. Additionally, in a preferred embodiment, upper edges of the support ribs 245 are contiguous with an interior surface 232 of the base 202.

The insert 310 is positioned in the generally cylindrical opening 240 of the base 202. The insert 310 is preferably detachably engaged within the cylindrical opening 240 of the base, but it can alternatively be fixedly attached to the opening 240. As shown in FIG. 5, the insert 310 comprises a generally cylindrical body 316. The body 316 has a generally cylindrical opening 328 passing longitudinally through at least an upper end 314 thereof. In the embodiment shown in FIG. 5, the generally cylindrical opening 328 passes entirely through the body 316.

As shown in FIG. 5, a plurality of longitudinal ribs 317 extend radially outward from the body 316. As shown in FIG. 4, the outer longitudinal edges 318 of the ribs 317 are sized to tightly abut against the interior wall 243 of the generally cylindrical opening 240 of the base 202, to thereby maintain the insert 310 in a substantially vertical orientation relative to the base 202. In the preferred embodiment shown in FIG. 5, a portion 319 of each of the ribs 317 of the insert 310 taper toward a lower end 312 of each of the ribs 317. The tapered end 319 of the insert 310 facilitates insertion of the insert 310 into the opening 240 in the base 202.

An end plate 320 is preferably formed on an upper end 314 of the insert 310. The end plate 320 preferably has a diameter greater than the opening 240 in the base 202 to thereby support the insert 310 on the base 202. A lower surface 322 of the end plate 320 is preferably contiguous with upper ends of the ribs 317. As shown most clearly in FIG. 5, an outer portion 326 of the end plate 320 extends beyond the edges 318 of the ribs 317, providing a support 326 for supporting the insert 310 on the upper end 246 of the opening 240 of the base 202.

The pole 210 is sized to tightly fit within the opening of the insert 310. A lower end 218 of the pole 210 is positioned in the opening 328 in the upper portion 312 of the insert 310. With the insert 310 positioned in the opening 240 of the base 202, the pole 210 extends substantially vertically upward from the base 202. As indicated in FIG. 5, when the circumference of the pole 210 is properly sized relative to the circumference of the insert opening 328, the lower end 218 of the pole 210 may be inserted only a relatively short distance into the upper portion 312 of the insert opening 328, yet still maintain the pole 210 in a substantially vertical orientation.

FIGS. 3 and 4 show a stack arrangement 4 of a plurality of disposable rain hoods 1. In this embodiment, a plurality of the disposable hoods 1 are stacked together. Each of the hoods 1 has a suspension portion 80 extending from the lower edges 20 of the flaps 2A, 2B. The suspension portion 80 is detachably connected to the lower edge 20 of the flaps 2A, 2B by a frangible perforation 22. The stack 4 is preferably provided with a display holder 90. The display holder 90 has a means thereon for suspending the display holder from the display stand, such as a pair of holes 92, or eyelets, velcro or other like attachment mechanism. The stack 4 of disposable hoods 1 is fixedly attached to the display holder 90 via the suspension portions 80 such that a selected disposable rain hood 1 may be selectively detached from the suspension portion 80 by pulling the disposable hood I relative to the holder 90 to thereby break the frangible perforation 22. In a preferred embodiment, the stack is originally provided with about 30–35 hoods, which provides a sufficient number of hoods for most applications, such as supplying heavy demand during a sudden rain shower, while avoiding an unduly bulky stack of disposable rain hoods 1 on the display stand 200.

In the preferred embodiment shown in FIG. 4, the display holder 90 is a piece of cardboard 90 or like material. The piece of cardboard 90 is folded over a plurality of the suspension portions 80. Opposing flaps 96A, 96B of the display holder 80 are attached to one another by a plurality of staples 94 passing through the plurality of suspension portions 80.

The foregoing stacked arrangement 4 provides a convenient means of handling multiple disposable rain hoods 1, such as during shipping and transport, and of displaying a plurality of disposable rain hoods 1 from a display stand 200. However, in an alternative embodiment, individual disposable rain hoods 1 can be provided with a pair of holes 92 adjacent and passing through said lower end 20 of said disposable rain hood 1, the holes 92 providing a means for displaying the disposable rain hood 1 from the display stand 200.

In operation, the disposable rain hoods of the invention 1 are displayed and dispensed from a display stand 200. In a preferred method of display shown in FIGS. 3 and 4, the display holder 90 of a stack 4 of disposable rain hoods 1 is attached to the prongs 216 such that the plurality of disposable rain hoods 1 depends downward from the display holder 90.

The disposable rain hoods 1 can be constructed according to the following methods. A sheet of plastic 1 is cut or provided in a lengthwise format, i.e. a generally rectangular shape (e.g. 30 by 37 inches). The sheet is folded substantially along a centerline (see e.g. 10 or 30) to thereby form the pair of flaps 2A, 2B. The flaps 2A, 2B are then heat sealed together substantially along an edge adjacent to the fold (see e.g 10 or 30). The folding and heat sealing thereby form a sealed upper edge 10 and a sealed rear edge 30, and also thereby leave an open front edge 40 and an open lower edge 20 of the disposable rain hood 1 for receiving a head and torso of a user 100 of the disposable rain hood 1.

A head stop 8 can be formed by heat sealing the flaps 2A, 2B together along a line 8 extending downward substantially from the sealed upper edge 10 of the disposable hood 1 and extending substantially parallel to an upper portion of the sealed rear edge 30, the head stop 8 being positioned a sufficient distance from the open front edge 40 of the disposable rain hood to thereby permit the head stop 8 to function as a rear barrier for a back portion of the head of the user 100 while the hood simultaneously shields the head of the user 100 from rain.

At least one hole 50 can be punched in each of the flaps 2A, 2B, preferably substantially along the forward edge 40, the holes 50 being positioned to permit the forward edges 40 of the disposable rain hood 1 to be selectively held together either by fingers of the user 100 or by a tie passing through the holes 50 to thereby secure the hood 1 on the user 100, as shown most clearly in FIG. 2.

The suspension portion 80 can be formed below the lower edge 20 by punching a frangible perforation 22 substantially along and adjacent the lower edge 20 of the flaps 2A, 2B, thereby leaving a desired length for the suspension portion 80.

Preparation of a stack 4 of disposable rain hoods is accomplished by first constructing a plurality of the disposable rain hoods 1. The plurality of disposable rain hoods 1 are then stacked together such that the suspension portions 80 are stacked atop one another and such that the upper edges 10 are stacked atop one another, as shown in FIGS. 3 and 4. A display holder 90 is then stapled or otherwise attached to the suspension portions 80, such that the plurality of disposable rain hoods 1 are held together at the suspension portions 80, such that the stack 4 may be suspended from a display stand 200 by a suspension means 92 on the display holder 90, and such that a selected disposable rain hood 1 may be selectively detached from the suspension portion 80 by pulling the selected disposable hood 1 relative to the display holder 90 to thereby break the frangible perforation 22.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A stacked assembly of disposable rain hoods for displaying and dispensing from a display stand comprising:

a plurality of disposable rain hoods, each said rain hood comprising:

a pair of opposing flaps, said flaps attached to one another substantially along respective upper edges thereof, said flaps further attached to one another substantially along respective rear edges thereof, said upper and rear edge attachments providing a rain-impermeable barrier along said upper and said rear edges of said disposable rain hood, said disposable rain hood having a substantially open front edge and a substantially open lower edge for receiving a head and torso of a user of said disposable rain hood, and a suspension portion extending from said lower edges of said flaps, said suspension portion detachably connected to said lower edge of said flaps by a frangible perforation, said plurality of said disposable hoods stacked together, and a display holder, said display holder having a means thereon for suspending said display holder from said display stand, said stack of disposable hoods fixedly attached to said display holder via said suspension portions such that a selected disposable rain hood may be selectively detached from said suspension portion by pulling said disposable hood relative to said holder to thereby break said frangible perforation.

2. The apparatus of claim 1, wherein said display holder is a piece of cardboard, said piece of cardboard being folded over a plurality of said suspension portions to thereby form a pair of opposing display holder flaps, and said display holder flaps attached to one another by a plurality of staples passing through said plurality of suspension portions.

3. The apparatus of claim 1, wherein said pair of flaps are formed from a single lengthwise sheet of plastic, said sheet folded substantially along a width-wise centerline thereof to thereby form said pair of lengthwise opposing flaps, said fold forming said upper edge of said disposable rain hood, and said rear edge attachment formed by heat sealing said rear edges of said flaps to one another.

4. The apparatus of claim 1, wherein said pair of flaps are formed from a single lengthwise sheet of plastic, said sheet folded substantially along a length-wise centerline thereof to thereby form said pair of lengthwise opposing flaps, said fold forming said rear edge of said disposable rain hood, and said upper edge attachment formed by heat sealing said upper edges of said flaps to one another.

5. A stacked assembly of disposable rain hoods for displaying and dispensing from a display stand comprising:

a plurality of disposable rain hoods, each said rain hood comprising:

a pair of opposing flaps, said flaps attached to one another substantially along respective upper edges thereof, said flaps further attached to one another substantially along respective rear edges thereof, said upper and rear edge attachments providing a rain-impermeable barrier along said upper and said rear edges of said disposable rain hood, said disposable rain hood having a substantially open front edge and a substantially open lower edge for receiving a head and torso of a user of said disposable rain hood, a head stop further attaching said respective opposing flaps to one another, said head stop extending downward substantially from said sealed upper edge of said disposable hood and extending substantially parallel to an upper portion of said sealed rear edge, said head stop being positioned a sufficient distance from said open front edge of said disposable rain hood to thereby permit said head stop to function as a rear barrier for a back portion of said head of said user while said hood simultaneously shields said head of said user from rain, and a suspension portion extending from said lower edges of said flaps, said suspension portion detachably connected to said lower edge of said flaps by a frangible perforation, said plurality of said disposable hoods stacked together, and a display holder, said display holder having a means thereon for suspending said display holder from said display stand, said stack of disposable hoods fixedly attached to said display holder via said suspension portions such that a selected disposable rain hood may be selectively detached from said suspension portion by pulling said disposable hood relative to said holder to thereby break said frangible perforation.

6. The apparatus of claim 5, wherein said display holder is a piece of cardboard, said piece of cardboard being folded over a plurality of said suspension portions to thereby form a pair of opposing display holder flaps, and said display holder flaps attached to one another by a plurality of staples passing through said plurality of suspension portions.

7. The apparatus of claim 5, wherein said pair of flaps are formed from a single lengthwise sheet of plastic, said sheet folded substantially along a width-wise centerline thereof to thereby form said pair of lengthwise opposing flaps, said fold forming said upper edge of said disposable rain hood, and said rear edge attachment formed by heat sealing said rear edges of said flaps to one another.

8. The apparatus of claim 5, wherein said pair of flaps are formed from a single lengthwise sheet of plastic, said sheet folded substantially along a length-wise centerline thereof to thereby form said pair of lengthwise opposing flaps, said fold forming said rear edge of said disposable rain hood, and said upper edge attachment formed by heat sealing said upper edges of said flaps to one another.

9. The apparatus of claim 5, wherein said head stop is formed by heat sealing said flaps to one another along said desired position of said head stop.

10. A method of displaying and dispensing disposable rain hoods from a display stand, said display stand having a base, a pole extending substantially vertically upward from said base, and a pair of display prongs positioned adjacent an upper end of said pole, comprising:

providing a stacked assembly of disposable rain hoods according to claim 1, and attaching said display holder of said stacked assembly to said prongs of said display stand via said suspension means such that said plurality of disposable rain hoods depends downward from said display holder.

* * * * *